US006349659B1

(12) United States Patent
Hood

(10) Patent No.: US 6,349,659 B1
(45) Date of Patent: Feb. 26, 2002

(54) SAILBOAT ROTATABLE KEEL APPENDAGE

(76) Inventor: Frederick E. Hood, 231 Homestead La., Portsmouth, RI (US) 02871

( * ) Notice: Subject to any disclaimer, the term of this patent is extended or adjusted under 35 U.S.C. 154(b) by 0 days.

(21) Appl. No.: 09/663,548

(22) Filed: Sep. 18, 2000

Related U.S. Application Data

(63) Continuation-in-part of application No. 09/371,346, filed on Aug. 10, 1999, now abandoned.
(60) Provisional application No. 60/095,944, filed on Aug. 10, 1998, and provisional application No. 60/035,918, filed on Jan. 23, 1997.

(51) Int. Cl.[7] ..... B63B 35/79
(52) U.S. Cl. ..... 114/39.21; 114/132
(58) Field of Search ..... 114/126, 127, 114/128, 132, 140, 149, 275, 152, 39.21

(56) References Cited

U.S. PATENT DOCUMENTS 3,990,384 A * 11/1976 Reynolds, III ..... 114/126
4,920,906 A * 5/1990 Collins ..... 114/140
5,003,904 A * 4/1991 Unger et al. ..... 114/140
5,313,905 A * 5/1994 Calderon ..... 114/140

* cited by examiner

*Primary Examiner*—Stephen Avila
(74) *Attorney, Agent, or Firm*—Bernhard Olcott

(57) ABSTRACT

A Rotatable Keel Appendage comprising a conical hollow support fixed to a sailboat hull into which is juxtapositioned a rotatable cone member which supports a fin keel carrying a heavy ballast bulb. The rotatable cone member has a threaded shaft at its peak which has a diameter greater than the thickness of the fin and is lockable to the fixed appendage conical hollow support by a nut on the threaded shaft. In another embodiment, the rotatable cone member carries two fins, in either spaced parallel relationship or in spaced aligned relationship. Mathematical Formulas for Energy Balance are developed to establish that a tacking sailboat with the appendages in the Specification will hydrodynamically generate forces to both decrease the leeward drift and increase the forward velocity of the hull. Methods for sailing more quickly to reach a windward destination are set forth using the appendages in the specification.

18 Claims, 14 Drawing Sheets

SAILBOAT ROTATABLE KEEL APPENDAGE

CROSS-REFERENCE TO RELATED PATENT APPLICATIONS

This is a continuation-in-part application incorporating by reference to: Utility Application Ser. No. 09/371,346 filed Aug. 10, 1999 claiming the priority date of its filing date of Aug. 10, 1999; Provisional Application Serial No 60/095944 claiming the priority date of its filing date of Aug. 10, 1998; and co-pending application Ser. No. 60/095944 filed on Jan. 23, 1998 which is based on Provisional Application Serial No. 60/035918 filed on and claiming the priority date of Jan. 23, 1997.

FIELD OF THE INVENTION

This application relates to under-water appendages for water-borne sailing vessels with heavy ballast bulbs as required for International Americas Cup Class (IACC) Yachts and in particular to rotatable fin keels which produce an asymmetric effect when tacking for generating enhanced hydrodynamic forces to increase the Velocity Made Good (VMG) of the sailing vessel so as to quicken its passage to a windward destination.

DEFINITIONS

In the description, the following terms have the following meanings: a "canoe body" is the hull of the vessel up to the sheer line excluding appendages; an "appendage" means an underwater protrusion from the underside of the canoe body such as a keel, fin, wing, dagger board, centerboard keel, rudder, etc.; "VMG" (Velocity Made Good) means the velocity of a tacking or reaching sailing vessel towards its windward destination; "leeward drift" means the drift to leeward of a tacking or reaching vessel caused by the wind; "appendage lift" means a force generated by a submerged moving appendage in the direction to counter the leeward drift by the wind of a tacking or reaching sailing vessel; "drag" means the resistance of water passing over any submerged surface; "appendage or keel drag" means the resistance of water passing over wetted surfaces of a keel or an appendage; "water track" is the direction of the body of water moving towards and impinging upon a canoe body; "crabwise motion" of a canoe body means that it is moving into the water track with its longitudinal axis at an angle thereto; "crabwise hull drag" means the additional drag of the canoe body when it has crabwise motion; "making leeway" means that the keel or appendage is producing an asymmetrical effect to generate a hydrodynamic force vector having a component to counter the leeward drift; "angle of incidence or "leeway angle" means the angle between the longitudinal centerline of a fin or appendage and the water track; an "asymmetric effect" means the creation of a hydrodynamic force when the water track is split into two paths which are reunited, one path of the water flow being longer than the other path of the water flow; a "symmetrical appendage" means an appendage having two opposite chord surfaces each with the same camber; an "asymmetrical appendage" means an appendage having two opposite chord surfaces of different cambers; "favorable wind shift" occurs when the apparent wind angle increases; and "Lift/Drag Ratio" of an means its the quantity of lift per unit of drag produced by a moving submerged appendage, the goal being to generate maximum lift with minimum drag.

Velocity Made Good (VMG) of a tacking or reaching vessel is the component of the sailing yacht's forward velocity vector which is directed towards the windward mark.

Skippers of racing yachts desire to win races and Skippers of cruising sailboats desire to shorten the time on tacking and reaching passages. Such goals can be favorably influenced with appendage design.

BRIEF SUMMARY OF THE INVENTION

In exemplary embodiments of the invention, an appendage unit includes one or more thin fins carrying a heavy ballast which is supported in a manner to permit rotation of the fin(s) and the heavy ballast about an axis perpendicular to the canoe body's waterline plane. The rotatable appendage unit is strongly fitted to its hull so as to avoid fin(s) breakage failure by bending moments thereon in heavy seas. The fin or fins are symmetrical in shape for generating a hydrodynamic force vector by water passing there over when the fin(s) are positioned at a selective leeway angle to the on-rushing water track.

In other exemplary embodiments, an articulated appendage unit has two components, one of which is rotatable to form either a symmetrical or asymmetrical appendage of selected shape, and one of which supports a heavy ballast bulb.

In exemplary methods of the invention to increase the forward velocity of a tacking sailing vessel, steps include eliminating the extra drag of a tacking canoe body which occurs when it is not arrowing into the water track and when the rotatable keel and ballast member are making leeway for increasing the canoe body forward velocity by reducing the leeward drift.

In another exemplary method of the invention to increase the forward velocity of a tacking sailing vessel, steps include tacking into the water track with a fin keel and ballast at a selected angle of incidence thereto, rotating the canoe body directly into the water track while maintaining the fin keel and ballast at the same selected angle of incidence relative to the water track and selectively adjusting the sails to take advantage of the more favorable angle of the apparent wind to the sails when the canoe body is rotated away from the apparent wind.

DESCRIPTION OF THE DRAWINGS

The drawings are not drawn to scale. The shapes, locations and dimensions of component parts are exaggerated so as to emphasize the inventive concepts.

Figure 3A:
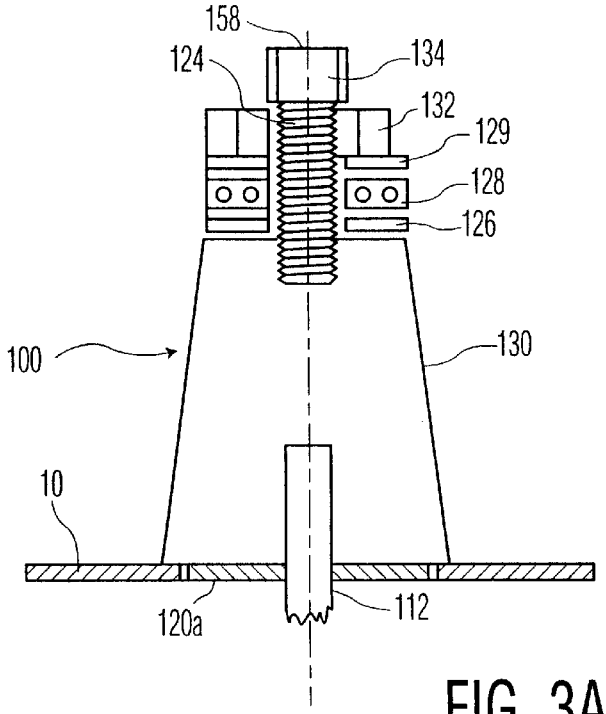
FIGS. 3, 3A, 3B, 3C, 3D and 3E illustrate an appendage unit according to the invention which has a thin fin supporting a heavy ballast bulb, the fin being rotatably supported by the canoe body.
Figure 3:
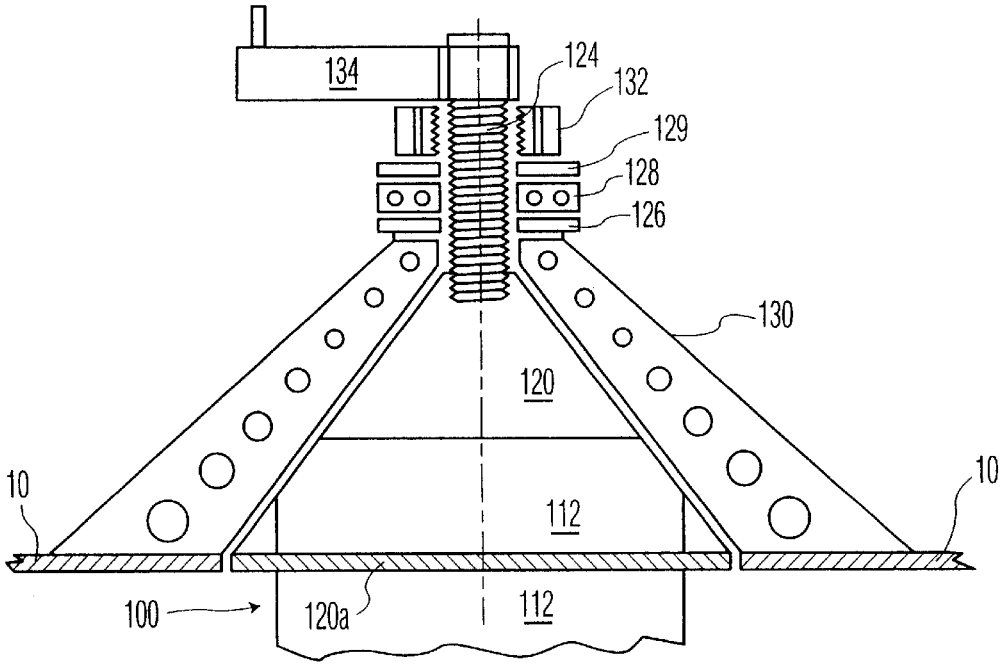
Figure 3C:
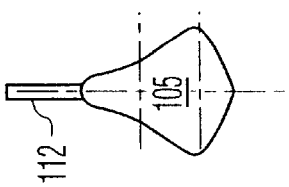
Figure 3B:
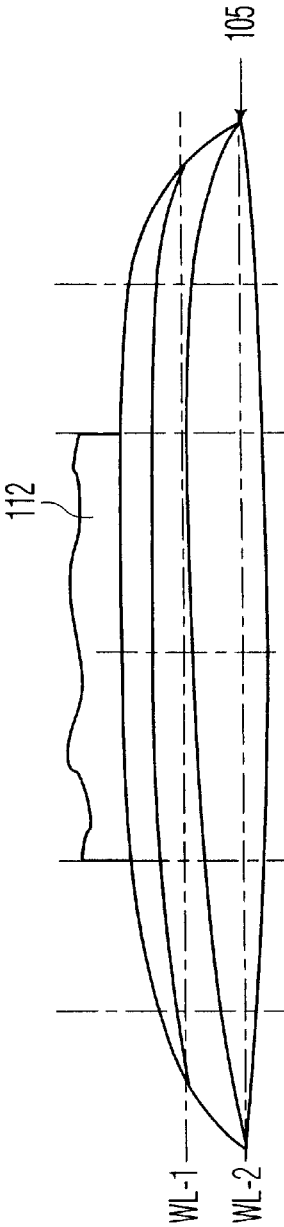
Figure 3D:
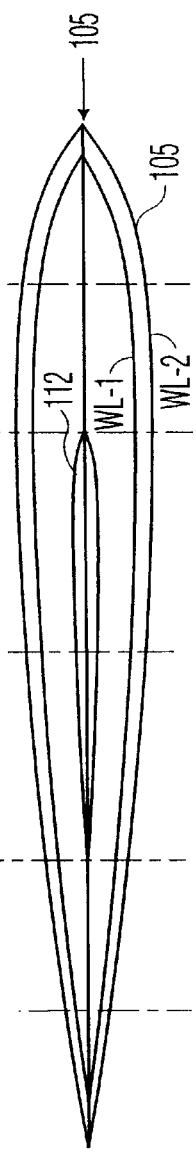
Figure 3E:
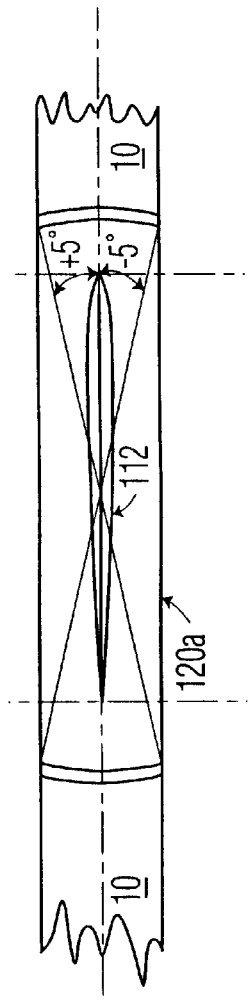
Figure 5A:
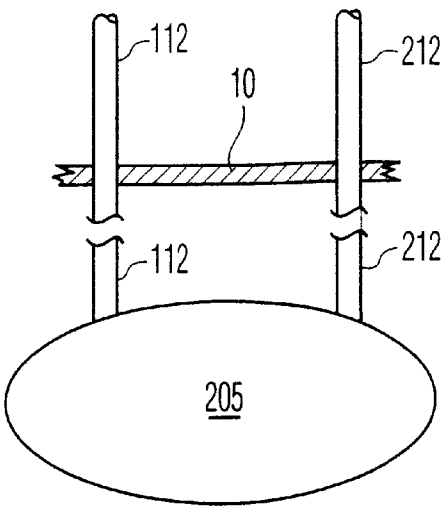
FIGS. 5, 5A, 5B and 5C illustrate a modification of the appendage unit in FIG. 3 by adding another fin to the appendage unit, both fins being fixed in side by side parallel relationship in the rotatable appendage unit and both fins supporting the heavy ballast bulb.
Figure 5:
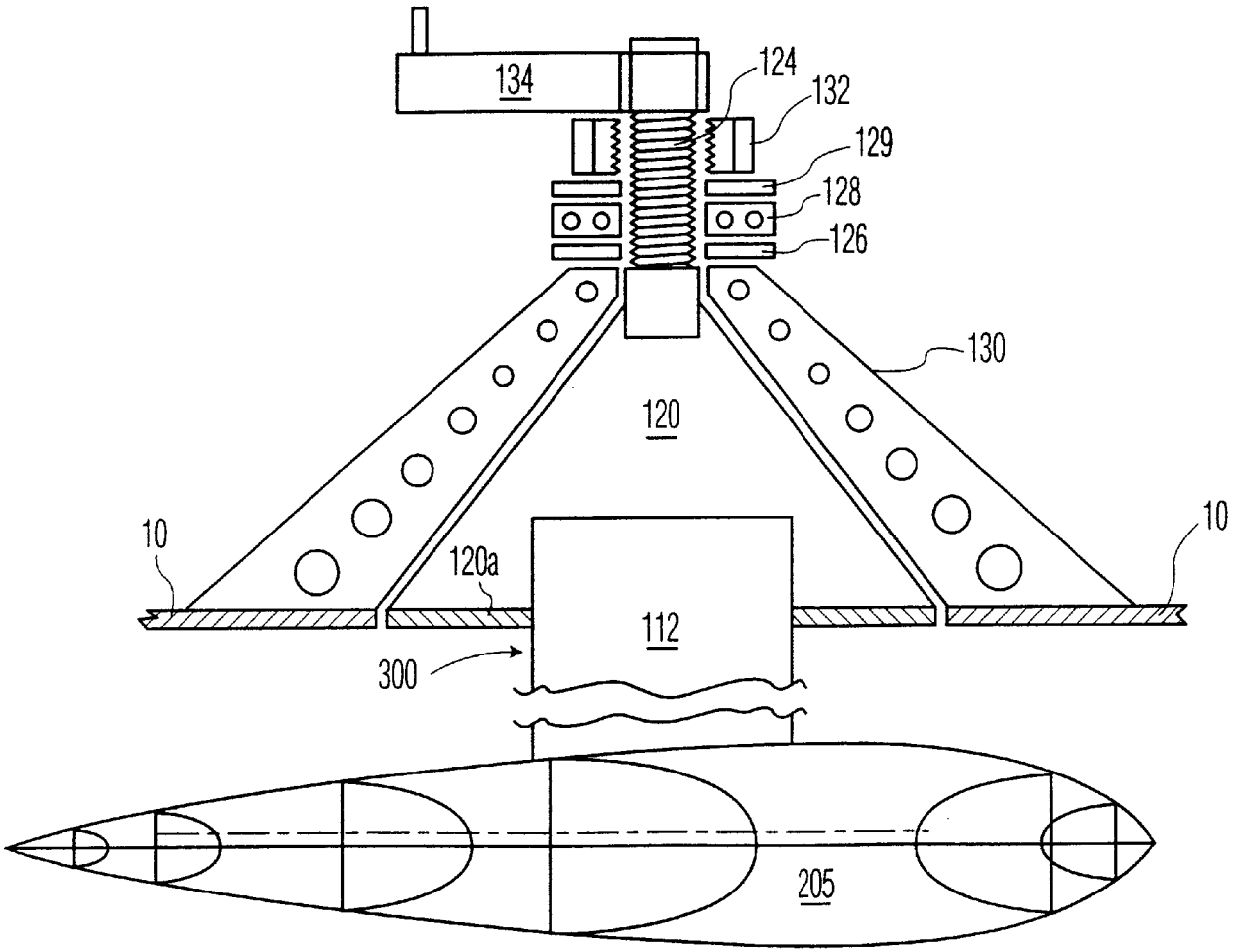
Figure 5B:
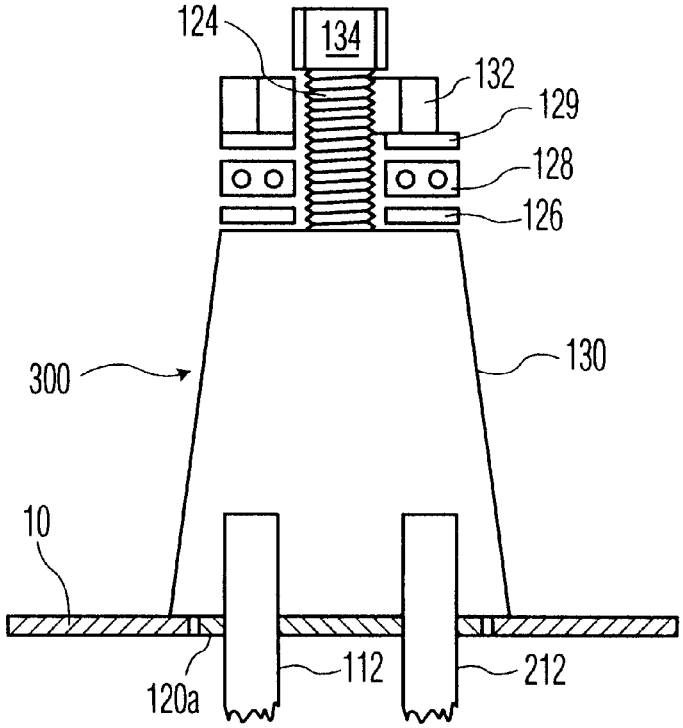
Figure 5C:
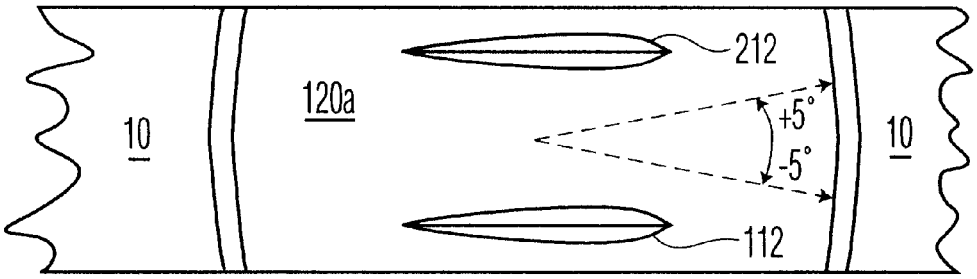
Figure 6A:
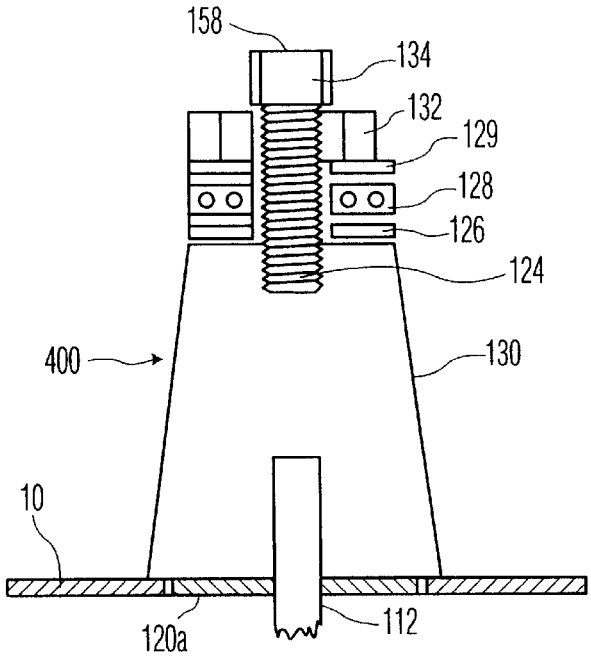
FIGS. 6, 6A, 6B, 6C, 6D and 6E illustrate a modification of applicant's rotatable appendage unit of FIG. 3 by adding another fin thereto in an aligned spaced fore and aft relationship, both fins being fixed in the rotatable appendage unit and both fins supporting the heavy ballast bulb.
Figure 6:
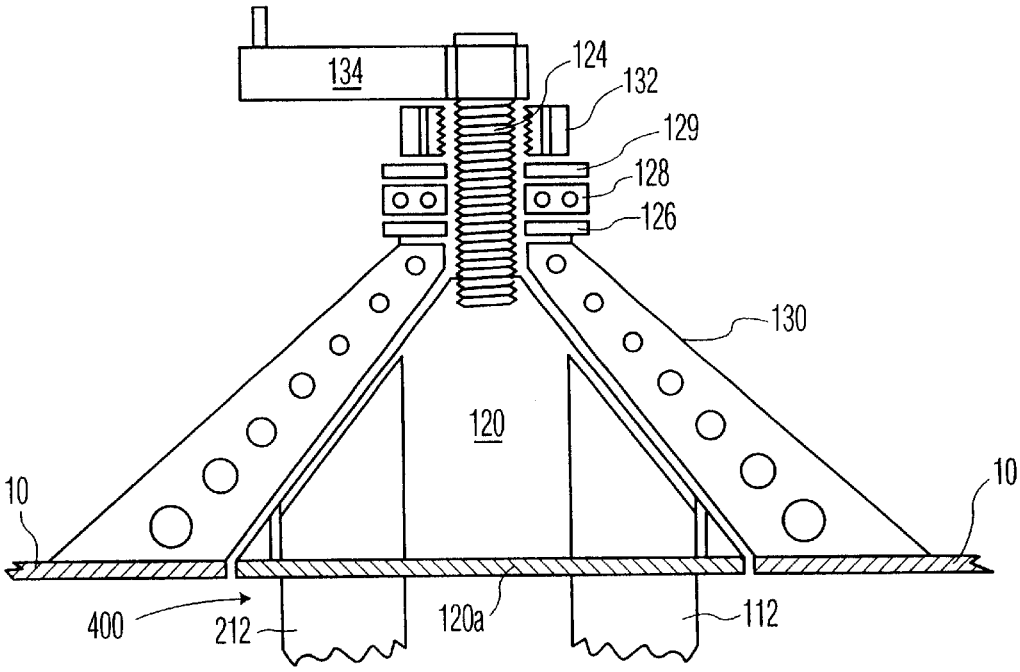
Figure 6C:
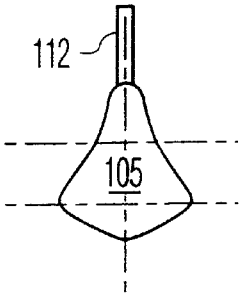
Figure 6B:
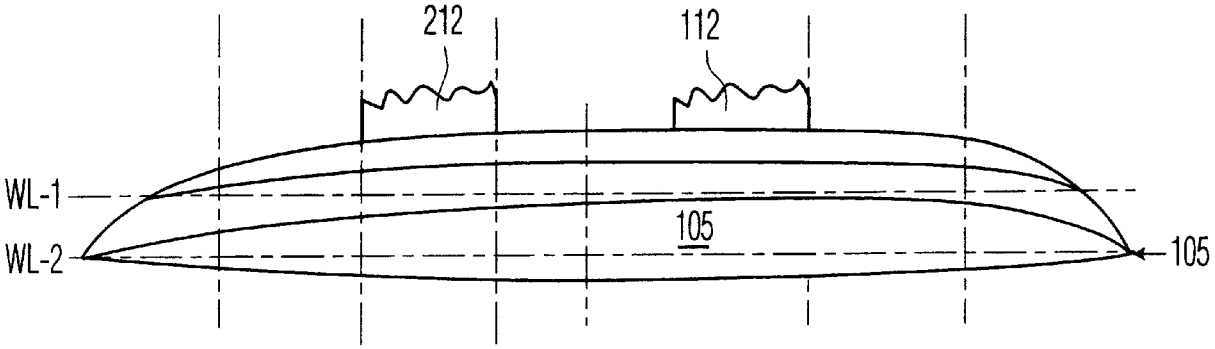
Figure 6D:
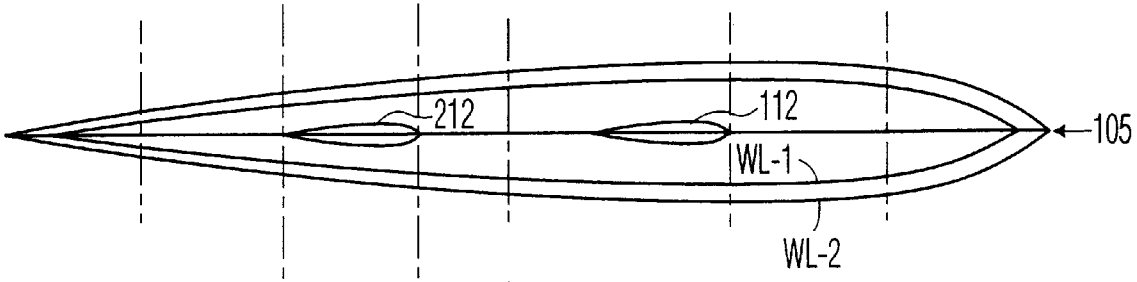
Figure 6E:
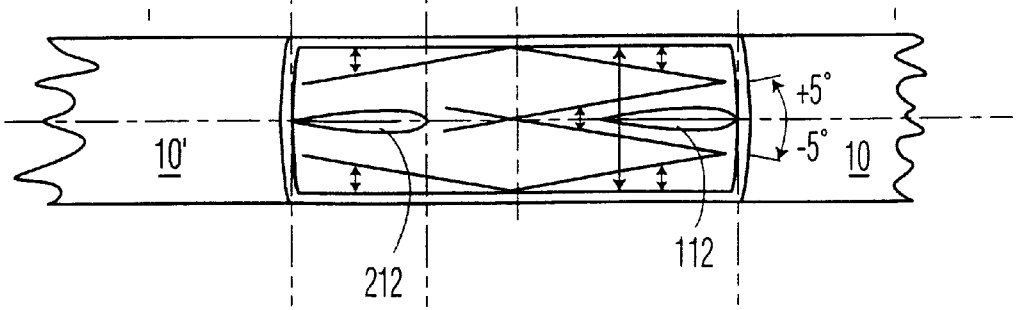
Figure 7A:
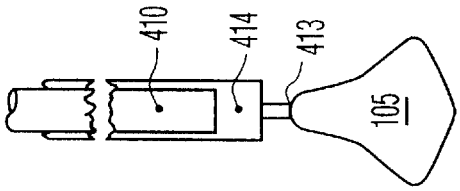
FIGS. 7, 7A, 7B, 7C, 7D, 7E and 7F illustrate an appendage unit with a two element articulated fin which can be shaped either symmetrically or asymmetrically, the aft portion thereof being fixed to the canoe body and supporting a heavy ballast and the fore portion thereof being rotatable about an axis perpendicular to the canoe body waterline plane.
Figure 7E:
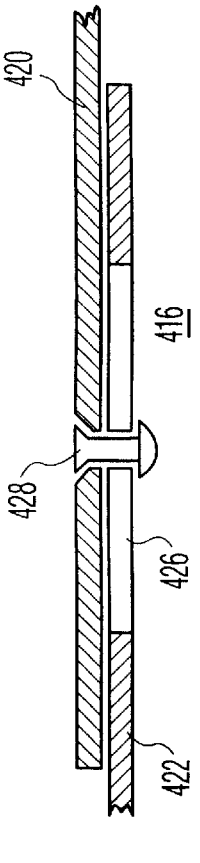
Figure 7F:
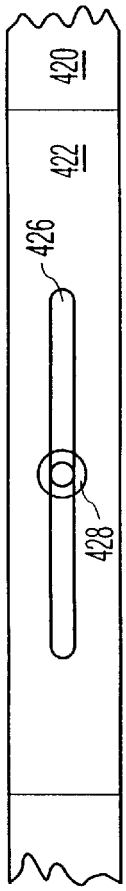
Figure 7:
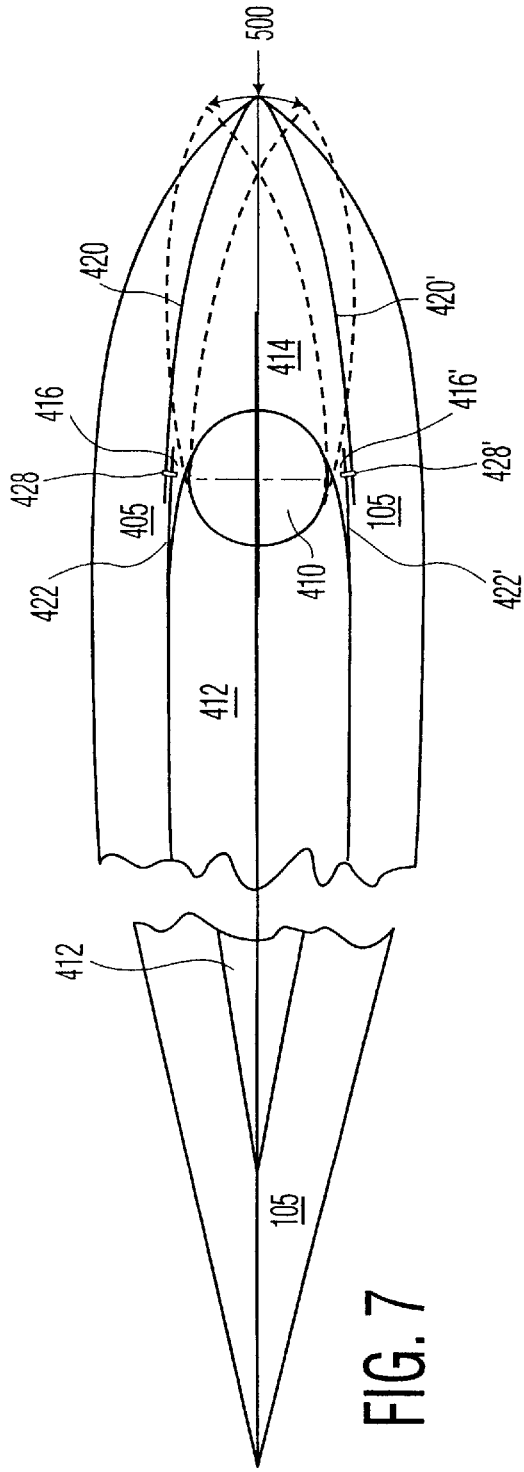
Figure 7B:
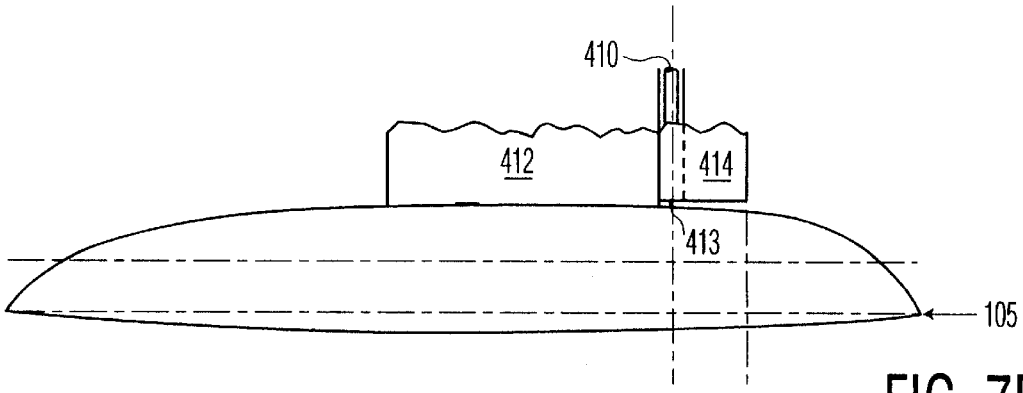
Figure 7D:
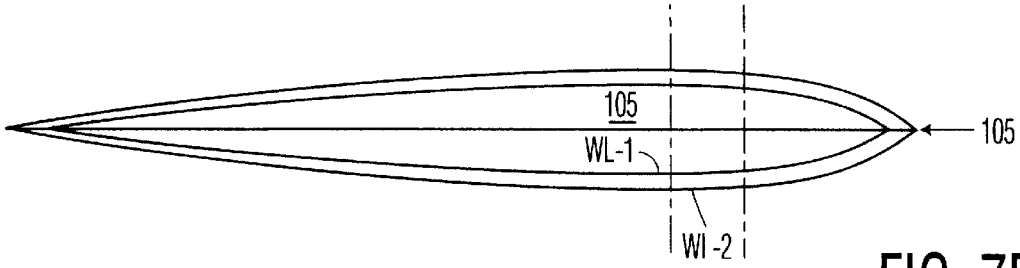
Figure 7C:
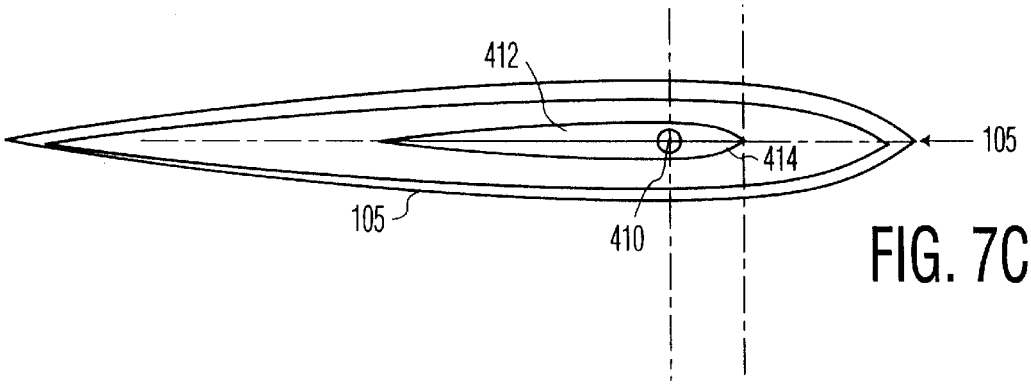

The embodiments of FIGS. 3, 5, 6, 7 and 9 of the Drawings can be allowed for the construction of an International Americas Cup Class Yacht which permits only two rotatable appendages, one of which is the rudder and the other one can be the rotatable cone (120) in FIGS. 3, 5 and 6 or the rotatable fore fin (414) of FIG. 7.

DETAILED DESCRIPTION OF THE INVENTION

Figure 1:
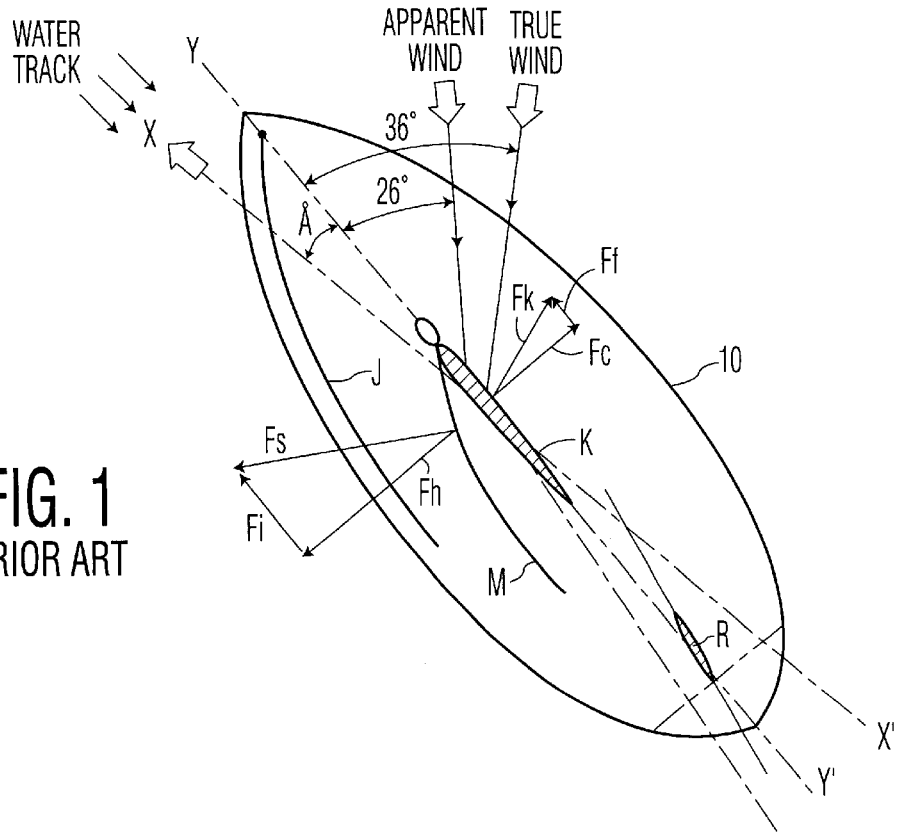
FIG. 1 PRIOR ART
FIG. 1 is a schematic diagram illustrating a windward sailing yacht with a fin keel fixed to the canoe body making leeway wyth the fin keel as known in the prior art.

As known in the prior art, FIG. 1 illustrates a canoe body 10 of a sailing vessel on starboard tack which is powered by the wind acting on its main sail M and jib J to generate a force Fs on the sails of canoe body 10 which has a component Fh to drift the canoe body 10 leewardly and a component Fi to propel the hull forwardly. The canoe body 10 is shown with a symmetrical fin keel K fixed thereto along the longitudinal centerline of the canoe body 10 which is angularly displaced from the water track by an angle Å, a symmetrically shaped rudder R and a ballast bulb (not shown) fixed to the lower end of the symmetrical fin keel K. A sailboat with a symmetrical fin keel needs to make leeway for the fin keel K to create a lift force by an asymmetric effect to counter the leeward drift of the canoe body 10 caused by the wind force Fh acting upon the sails J and M. In the hands of a skillful helmsman, a symmetrically shaped rudder R can also produce a desirable lift force by an asymmetrical effect when it makes leeway with a selective angle of incidence with the water track. For producing a favorable hydrodynamic force Fk by the keel, the canoe body is skillfully steered by rudder R into the wind so that the longitudinal axis of the keel makes a selected leeway angle Å of between 1° and 10° with the water track. This causes the drag of the canoe body to be increased because the canoe body longitudinal axis Y–Y' is not "arrowing" directly into the on-rushing water track since the canoe body moves crabwise in the direction of X–X'. Advantageously, the keel should have a high lift/drag ratio shape. In racing sailboats, some Skippers will favor pointing the canoe body 26° off the apparent wind or 36° off the true wind.

Figure 2:
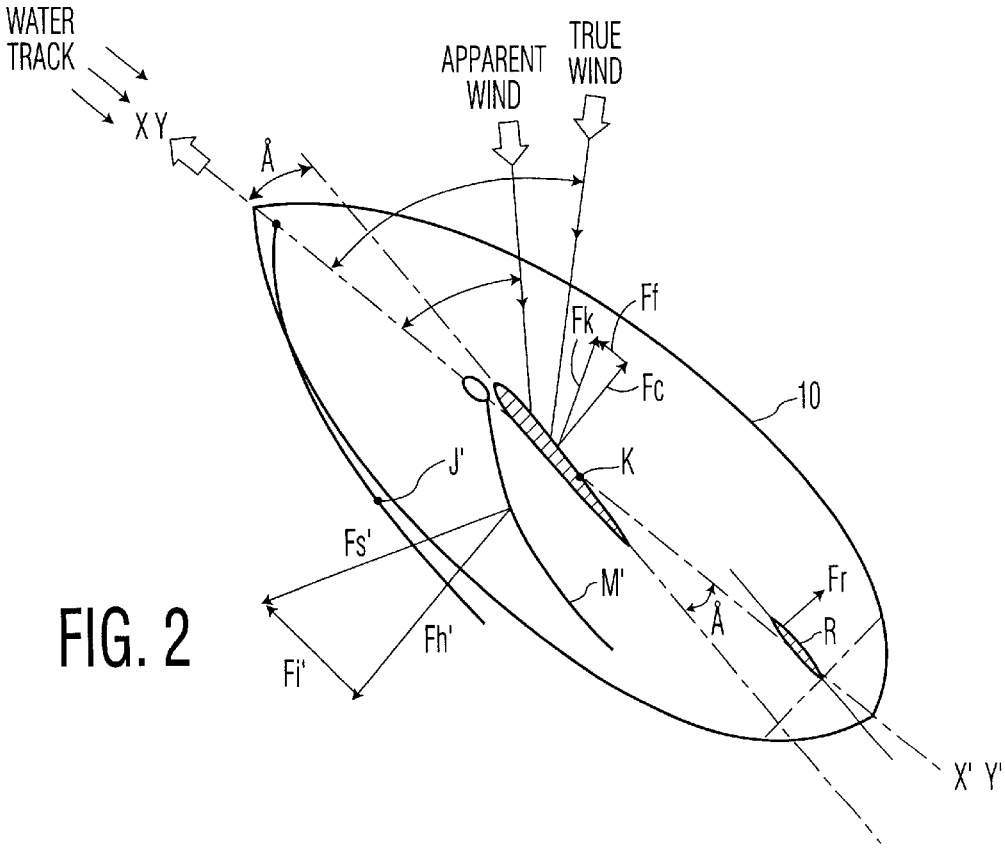
FIG. 2 is a schematic diagram of a windward sailing yacht illustrating applicant's concept to reduce canoe body drag of the yacht in FIG. 1 and to produce the equivalent of a favorable wind shift without lengthening the path to the windward mark.

In accordance with the invention, FIG. 2 is a schematic diagram of a tacking sailing yacht with a rotatable keel k sailing directly into the water track with its keel K at the same as the angle Å to the water track as in FIG. 1.

Comparing FIG. 2 with FIG. 1, both have the same keel K and both have the same generated force vector "Fk because each has the same angle of incidence Å to the water track. However, the canoe body in FIG. 2 has a favorable wind shift of Å when the angle of its bow to the apparent wind angle is increased by the angle Å. This permits skilled trimming of the jib, main sail and adjusting the traveler for reshaping the main sail from M to M' and the jib sail J to J' with result that Fs' (the wind force transmitted to the canoe body in FIG. 2) is greater than Fs (the wind force transmitted to the canoe body in FIG. 1). Accordingly, the canoe body velocity is increased by: (a) eliminating crabwise motion drag in FIG. 1 and (b) producing the equivalent of a favorable wind shift.

As shown in FIG. 1, the sailing vessel has tacked into the wind and is on starboard tack as powered by the wind acting on its main sail M and jib J to generate a force Fs on the sails of the canoe body 10 which has a component Fh to drift the canoe body leewardly and a component Ff to propel the hull forwardly. The canoe body 10 is shown with a symmetrical fin keel K fixed thereto and a prior art ballast bulb (not shown) fixed to the lower end of the symmetrical fin keel K. A sailboat with a symmetrical fin keel fixed to the canoe body has to be steered into the water track so that its fin keel K creates an asymmetric effect to counter the leeward drift of the canoe body 10 caused by the wind component Fh acting upon the sails J and M.

For producing a favorable asymmetric effect in accordance with the invention, the fin(s) and appendages are designed so that the generated keel lift force vector Fk is favorably tilted towards the bow of the canoe body 10 so that it has a forward component force vector "Ff" to increase the yacht's forward velocity as predictable by the Energy Balance Formula (2) hereinafter. The keel lift force vector Fk also has a component Fc perpendicular to the longitudinal axis of the canoe body which is counter to and reduces the leeward drift of the canoe body to (Fh−Fc). The extra canoe body drag caused by its non-arrowing approach to the water-track and the resulting increase in hull drag is due to the large mass of water that the port side of the hull has to push aside and the motion of the canoe body into the water track is crabwise. When the canoe body is on starboard tack as shown in FIG. 1, a bow wave is unavoidably formed on its port bow in accordance with the inviolatable laws of fluid dynamics. Similarly, a bow wave is unavoidably formed on its starboard bow when the canoe body in FIG. 1 is on port tack.

Referring to FIG. 1, when the keel is not making leeway, it does not create an asymmetrical effect, Fc is zero and the wind drift force Fh on the sails leewardly drifts the canoe a distance of Yh feet per unit time. The wasted drift energy per unit of time is (Fh×Yh). When the fin keel K in FIG. 1 produces a hydrodynamic keel lift, the wind drift force Fk is reduced by 25%, the wind drift force distance Yh is reduced by 25% (as caused by the 25% reduction in the leeward wind drift force Fh) and the wasted leeward wind drift energy (0.75 Fh×0.75 Yh) is potentially reduced to 56% (0.75×0.75) of what it was prior to the asymmetric effect influence of the fin keel K. However, the potential wasted energy of 44% (100%−56%) is not completely achievable because of the influence of induced keel drag, keel downwash, keel tip vortex, turbulence, more entrophy losses, etc.

Energy Balance

Energy analysis must observe the First and Second Laws of Thermodynamics which are inviolate. The two Laws are:

First Law. Energy can neither be created nor destroyed. Energy can only be transferred, and Second Law. All exchanges of energy are made with energy loss which explains one reason why perpetual motion can not be achieved. The measure of this loss in every energy interchange is quantitatively expressed by the thermodynamic term "Entropy" as the index of unavailability of energy.

The source of energy for a sailing vessel is the wind energy which can only be transferred and not be destroyed in accordance with the First Law.

Based upon the First and Second Laws, energy balance formulas will be developed for a tacking sailing yacht having a new and novel fin keel to create a favorable hydrodynamic force for (a) reducing its leeward drift, (b) increasing its forward velocity, (c) reducing the canoe body drag by eliminating crabwise motion thereof, and (d) creating a favorable wind shift.

Energy Balance when the Yacht is Sailing Downwind

When the yacht is sailing directly downwind, the energy of the wind is transferred to the sails (with some entropy loss) and the energy from the sails is transferred to the hull via the mast, shrouds, stays and sheets (with more entropy losses). The wind energy "We" is transferred to the hull to provide: (a) energy "Fe" to propel the yacht forwardly, (b) the wasted energy of hull drag is "He, (c) the wasted energy of the keel drag "Ke" and (d) the unavoidable entropy loss "Te" due to the energy transfers.

The Energy Balance for a yacht sailing downwind is:

$$We=Fe+He+Ke+Te \quad (1)$$

where

We=Energy of the wind transferred to the canoe body

Fe=Energy of the wind which forwardly propels the sailing vessel

He=Energy wasted by drag of the hull

Ke=Energy wasted by drag of the keel

Te=Total Entropy lost energy by all the energy transfers

Energy Balance when the Yacht is Tacking

The theory of Energy Balance can explain how the forward velocity of a sailing vessel on tack can be increased by a fin keel generating an asymmetrical effect.

The Energy Balance for the tacking yacht in FIG. 1 is:

$$We=(Fe+Fe')+(Le-Le')+He+Ke+(Te+Te') \quad (2)$$

where

We=Energy of the wind transferred to the canoe body

Fe=Energy of the wind which forwardly propels the sailing vessel when the canoe body is pointing directly into the water track Fe'=Incremental energy available to increase the forward velocity of the canoe body when the keel is making leeway Le=Energy wasted by the canoe body drifting leewardly by the wind when the keel is not making leeway Le'=Energy saved when the keel is making leeway He=Energy wasted by drag of the canoe body Ke=Keel drag wasted energy when it is making leeway Te=Total Entropy lost energy by the energy transfers when the keel is not making leeway Te'=Incremental increase in entrophy when the keel is making leeway whereby the forward velocity of the canoe body is increased by the asymmetric effect of the fin making leeway, and when Le' is greater than "Te'".

Energy Balance for a New and Novel Keel

The specification will disclose and teach how to construct an appendage for a sailing yacht which will quicken the passage when it is tacking or reaching to a distant destination.

FIG. 2 illustrates one embodiment of the invention in which the keel K is selectively rotated about a vertical axis on the longitudinal centerline of the canoe body. In such embodiment, the bow of the canoe body 10 is steered directly into the water track without changing the angle of incidence Å of the rotatable keel to the water tract as shown in FIG. 1. The resulting increase in the forward speed of the hull is due to: (a) reducing the hull drag energy, and (b) creating a favorable wind shift when the hull is pointed away from the apparent wind.

The energy balance for FIG. 2 then becomes:

$$(We+We')=(Fe+Fe')+(Le-Le')+(He-He')+Ke+(Te+Te') \quad (3)$$

where

We=Energy of the wind transferred to the canoe body when the canoe body is pointing at an angle to the water track We'=Incremental increase in the energy of the wind transferred to the canoe body when the bow of the canoe body is turned away from the wind and directly into the water track and when the sails are adjusted to the resulting favorable wind shift Fe=Energy of the wind which forwardly propels the sailing vessel when the canoe body was pointing at an angle to the water track Fe'=Incremental increase in the energy transferred to the canoe body which increases its forward velocity when the bow of the canoe body is turned away from the wind and is sailing directly into the water track while the keel remains making leeway and the sails are adjusted to the resulting favorable wind shift Le=Energy wasted by the canoe body drifting leewardly by the wind when the keel is not making leeway Le'=Energy saved when the leeward drift of the canoe body is reduced by the asymmetric effects of the keel He=Energy wasted (d1+d2+d3) by drag of the canoe body when it is pointing at an angle to the water track where d1 is the energy wasted drag of the bow wave, d2 is the energy wasted drag by the crabwise motion of the canoe body, and d3 is the energy wasted drag of the canoe body when there is no bow wave and no crabwise movement of the canoe body into the water track He'=Savings in drag energy when the canoe body is turned directly into the water track, the savings being equal to (d1+d2)

Ke=The drag of the keel when it is moving at an angle of incidence to the water track Te=Entropy lost energy when the canoe body is pointing at an angle to the water track Te'=Incremental increase in entropy when the canoe body is turned directly into the water track.

whereby, the forward velocity of the sailing vessel is increased by the energy increment "Fe'" as "d1" (the drag energy of the bow wave); plus "d2" (the drag energy of the crabwise movement of the canoe body) are eliminated when the canoe body is steered directly into the water track, by the incremental "We'" of wind energy "We" when the canoe body is turned and steered directly into the water track to create a favorable wind shift; by the energy saved "Le'" being created by the asymmetrical effects of the keel when it is making leeway and "We'+"Le'"+"He'" is greater than "Te'".

Novel Method For Racing Sailboats

To reach a windward mark in the shortest time, the concept as displayed in FIG. 2 can be implemented on the water for winning races as follows:

(1) on a windward course behind the starting line and crossing the starting line, the skilled helmsman positions the rotatable symmetrical keel in alignment with the longitudinal axis of the canoe body and steers the canoe body so that its keel has a favorable angle of incidence to the water track leeway as illustrated in FIG. 1 and depending on the design of the yacht, the wind and sea conditions, some replacing Skippers position the canoe body Y–Y' axis at 36° from the true wind or 26° from the apparent wind;

(2) after the maximum forward speed is attained in step (1), the vigilent helmsman quickly turns and steers the away from the wind and bow away from the wind and directly into the water track as illustrated in FIG. 2 while at the same time skillfully turning the symmetrical keel to maintain unaltered its angle of incidence relative to the water track as established in step (1);

(3) the vigilent helmsman quickly and selectively slackens the jib and main sheets while adjusting the traveler to reshape the jib and main sails for maximizing forward speed into the water track;

(4) when the vigilant helmsman wants to shorten the path to the windward mark, he steers the bow higher into the wind as shown in FIG. 1, adjusts the traveler and trims the jib and main sheets to skillfully flatten the sails;

(5) the vigilant helmsman improves the VMG by a skillful trading of some amount of canoe body forward velocity for a shortening of the length of the path to the windward mark; and (6) as opportunities arise, the vigilant helmsman skillfully switches back to steps (2) & (3), then to steps (4) & (5), then back to steps (2) & (3) then to steps (4) & (5), etc.

FIGS. 1 and 2 can also illustrate two yachts racing on starboard tack, both yachts are on the same path to the windward mark (the path of travel (XY×Y') in FIG. 2 is parallel to (X,Y in FIG. 1). The canoe body in FIG. 2 has a larger forward velocity because: (a) (Ff+Ff') in FIG. 2 is greater than (Fe+Fi) in FIG. 1; (b) the crabwise motion drag in FIG. 1 is eliminated; and (c) Fi' in FIG. 2 is greater than Fe in FIG. 1 due to the resulting favorable wind shift.

Preferred Embodiment

Figure 9B:
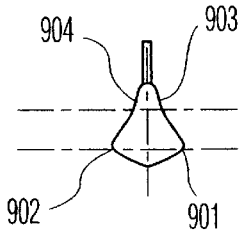
FIGS. 9, 9A, 9B, 9C and 9D illustrates details of the shape of the ballast bulb in FIGS. 3, 4, 6, 7 and 8.
Figure 9C:
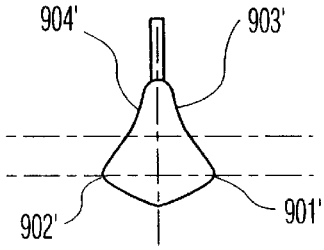
Figure 9D:
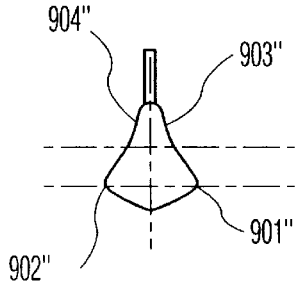
Figure 9:
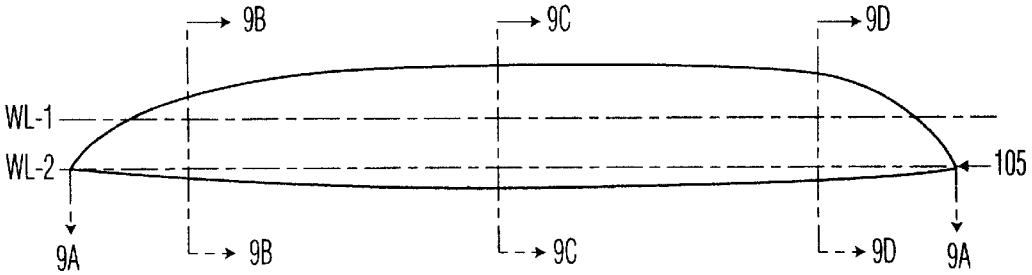
Figure 9A:
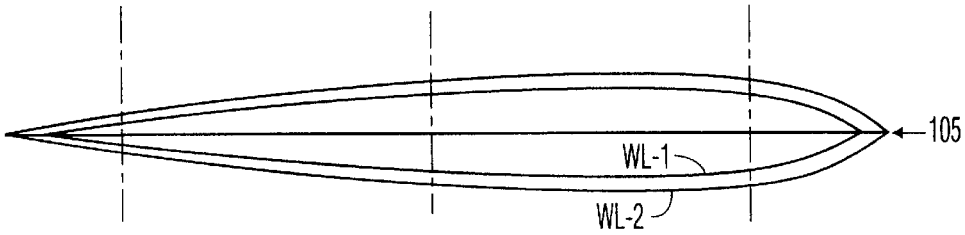

FIG. 3 illustrates an appendage unit 100 which comprises a rotatable cone 120 with base 120*a* and a thin fin 112 which is fixed at its upper end to the interior of cone 120 after it passes through an aperture in the cylinder base 120*a* of the cone 120 and into the interior of cone 120 to which it is removably pinned or bolted. The lower end of fin 112 is fixed to a heavy ballast bulb 105, such as lead, to provide the necessary righting moments to the canoe body 10 when it is close hauled. When the symmetrical ballast bulb 105 has the shape as in FIG. 9 with convex sides from its front to its rear, advantageously it will provide ballast lift as it makes leeway along with fin 112 and both members have the same angle of incidence into the water track. Advantageous, most of the ballast bulb weight in FIG. 9 is located at its bottom to lower the ballast center of gravity and it has rounded corners to reduce drag. The appendage unit 100 has a support 130 which is structurally and soundly anchored to the inside bottom of the canoe body 10. The support 130 has an internal cone surface to closely mate with the external cylindrical surface of the cone 120. The top of the cone 120 has a threaded shaft 124 which has a greater diameter than the thickness of the fin 120. A washer 126 is positioned over the shaft 124 and bears upon the top of the appendage support 130. Optionally, a roller or ball bearing 128 is positioned over the shaft 124 and over the washer 126 and a washer 129 is positioned over the bearing 128. A nut 132 is screwed onto the threaded shaft 124 over washer 129. The nut 132 is selectively tightened for fixing the position of the cone 120, the fin 112 and the heavy ballast bulb 105. Easy rotation of the appendage unit 100 is achieved with the aid of grease between the female surface of the appendage support 130 and the male surface of the cone 120. When the nut 132 is properly snugged, the rotatable fin 112 can be reliably positioned in a fixed position at a selective angle relative to the longitudinal centerline Y–Y' of the canoe body 10 by a turning lever 134. A hydraulic ram cylinder (not shown), as known in the prior art, can be installed to move and secure a selective position of the turning lever 134 from a remote location when the windward tack is changed from starboard to port, and visa versa. When grease does not adequately lubricate the closely mating conical surfaces of 120 and 130, roller bearings (not shown) can be placed between them to reduce the friction when the fin 112 and heavy ballast bulb 105 need less turning effort.

If it is desired to make angular movements of appendage unit 100 automatic by the heel of the tacking canoe body 10 when it changes its windward tack, the ballast bulb 105 can be dimensioned so that its center of gravity relative to the centerline of the cone threaded shaft 124 can flip the rotatable fin 112 by gravity and selective tightening of nut 132 when the heel changes from port to starboard.

In dry dock when the pins or bolts securing the fin 112 to the cone 120 are removed, the cone 120 and fin 112 of the appendage 100 and ballast bulb 105 can be removed downwardly from the canoe body 10 for installation of a different fin 112 and/or a different ballast bulb 105. By installing a series of appendage supports 130, 130' 130 " . . . 130"" (not shown) along the longitudinal centerline Y–Y' of the canoe body 10, the fore and aft location of the cone in the appendage unit 100, can be selectively changed between races to adjust the weather helm and/or to change the shape and size of the fin 112 and ballast bulb 105 as wind and sea conditions change.

As a weight reducing measure, the cylinder cone 120, 120*a* and appendage support 130 can be fabricated with known construction techniques using strong light weight material, such as carbon fibre, to reduce weight located near the waterline. Also, the fin 112 can be constructed of carbon fibre for the favorable concentration of allowable weight in the ballast bulb 105 at the bottom end of the fin 112.

Thin fins are advantageous for high lift/drag ratios and merely attaching a rotatable shaft to the thin fin in the manner similar to a shaft being attached to a rotatable rudder lacks sufficient strength to support the heavy ballast bulb attached to the lower end of the thin fin. All of applicants embodiments in FIGS. 3 to 6 solve the outstanding problem of rotatably supporting a heavy ballast bulb by a thin fin having desirable dimensions such as four inches in thickness and four feet long. In the prior art such was unsuccessfully attempted by attaching a vertical rotatable round shaft to the upper end of the thin fin, such shaft having to have a diameter less than the thickness of the thin fin. Such construction was successful for rudders but when applied to rotating keels with heavy ballast members attached to the bitter end thereof, they had sheer and bending failures in heavy seas especially when the canoe body was maximum heeled.

As taught in this specification, a strong attachment joint of the fin 112 to the interior of the cone 120,120*a* is provided by a long support seam (which would be eight feet for a four foot long fin 112) as the fin 112 passes through the cone base 120*a*. Such eight foot long seam is much longer than the periphery of a round shaft having a diameter less than the thickness of the thin fin 112. For a fin which is four inches in thickness, the supporting three and a half inch diameter round shaft only has a periphery of less than one foot. For the strong attachment of fin 112 to the canoe body in FIG. 3, the fin 112 in FIG. 4 and the fins 112,212 in FIGS. 5 and 6, the fin(s) extend a considerable distance through the cone base 120*a* and into to the interior of cone 120. Very advantageously by the combination of the cone 120,120*a* and the appendage support 130 there is provided a large resisting moment arm perpendicular to the fore and aft axis of the canoe body which is far greater than that provided by the prior art round shaft supporting a rotatable keel with heavy ballast member attached thereto. The bending moment arm of the keel and ballast is greatly increased from one half of the diameter of the prior art round shaft to one half of the athwart width of the appendage support 130 in FIG. 3A. A large supporting moment arm is desired to contend with the large bending moments by the heavy ballast bulb 105 when the canoe body is close hauled and rolling and pitching in heavy seas. While the base 120*a* of the cone 120 can be completely circular in outline, only the fore and aft ends of cone 120,120*a* and appendage support 130 need be a portion of a complete geometric circle as shown in FIGS. 3, 4, 5 and 6 because the appendage units 100, 200, 300 and 400 need to be rotated only a maximum of +10° or −10° from the fore and aft longitudinal axis of the canoe body 10. Optionally, the member supporting the upper end of fin 112 can be a cylinder instead of the cone 120 as shown in FIGS. 3 to 6.

This embodiment of the invention is a improvement over the prior art for a windward sailing yacht by: (a) eliminating crabwise motion of the canoe body to reduce canoe body drag of the yacht in FIG. 1, (b) producing the equivalent of a favorable wind shift without lengthening the path to the windward mark and (c) producing ballast lift to enchance keel lift.

Figure 4A:
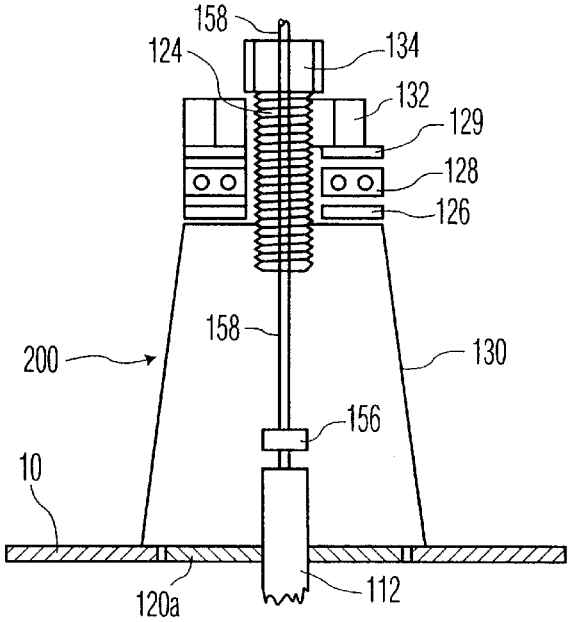
FIGS. 4, 4A, 4B, 4C, 4D and 4E illustrate a modification of the appendage unit in FIG. 3 by adding a trim tab to the fin.
Figure 4:
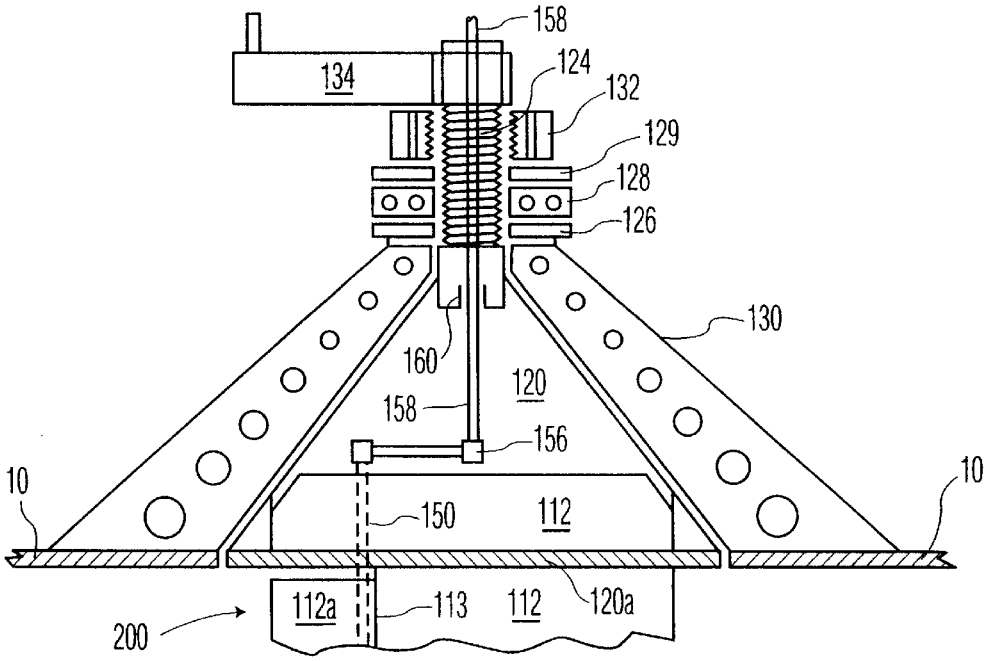
Figure 4C:
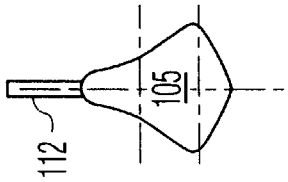

In the appendage unit 200 of FIG. 4, the asymmetric effect produced by the water track passing over the fin 112 can be increased by a skillful rotation of a trim tab 112*a* installed at the trailing edge of the fin 112. The rotatable joint between fin 112 and trim tab 112*a* has a ball and socket joint 113 so that the trim tab 112*a* can be angularly displaced by a vertical shaft 150. Shaft 150 is driven in a known manner by a right angle gear box, the horizontal input shaft being driven by another right angle gear box 156. The input shaft 158 of gear box 156 vertically pass through a cavity 160 in the centerline of the threaded shaft 124. In the manner known in the prior art, the control of the shaft 158 is transferred to the helmsman who skillfully turns it to selectively position the fin flap 112*a* in combination with a skillful rotation of cone 120 to produce a large asymmetric effect for the fin 112.

Figure 4B:
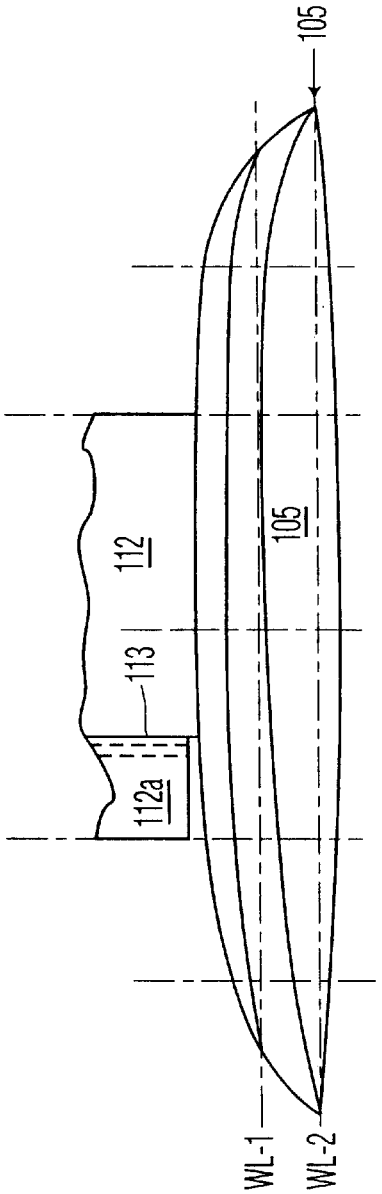
Figure 4D:
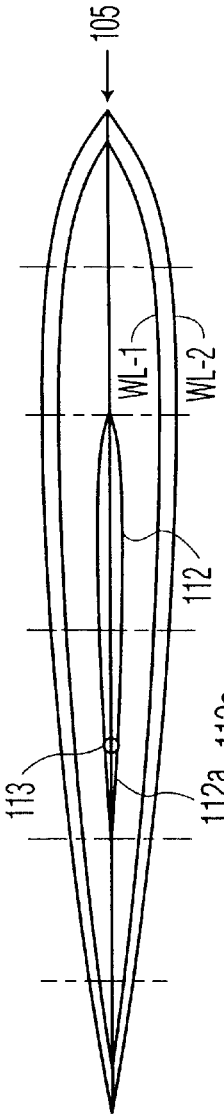
Figure 4E:
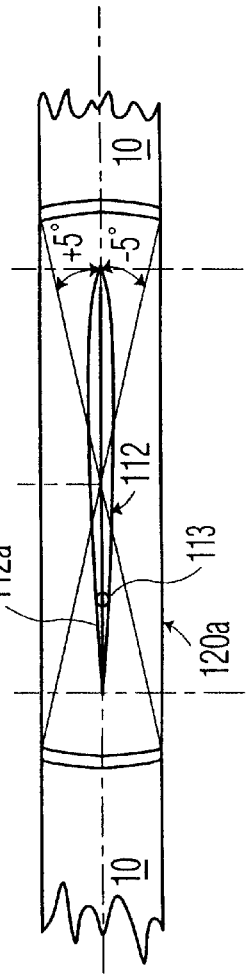

So as to remove the hollow in the ball joint 113 when trim tab 112*a* is rotated, advantageously there can be installed in FIGS. 4 and 4B port fairing flaps which are similar to 420 and starboard fairing flaps similar to 420' to envelope the ball joint 113 as shown in FIG. 7 to envelope ball joint 113 for reducing drag.

In FIG. 5, an enhanced appendage unit 300 results by adding another fin 212 to the appendage unit 100 of FIG. 3 (which illustrates only one fin 112) to form two symmetrical parallel side by side spaced identical symmetrical fins 112, 212, both being shorter than the single fin in FIG. 3. Both fins 112,212 are fixed to an elliptical ballast member at their lower ends and at their upper ends to the cone base 120*a* of appendage unit 300 which is rotatable +10° to −10° from its centerline position. The streamlined ballast bulb 205 in FIG. 5 has oval cross sections along its longitudinal axis with its major axis parallel to the waterline plane of canoe body 10. The elliptical ballast bulb 205 having longitudinal convex cross sections will advantageously produce ballast lift along with fins 112 and 212 when the fins and the ballast 205 produce an asymmetrical effect by their same angle of incidence to the water track.

The advantages of the appendage unit 300 of FIG. 5 over appendage unit 100 of FIG. 3 are that (1) the appendage unit 300 with two spaced parallel fins 112,212 can potentially provide more favorable asymmetrical effect so as together they potentially generate a larger resultant hydrodynamic force vector with a larger component for increasing the forward speed of the canoe body and a larger component for reducing leeward drift (2)the two fins 112,212 in FIG. 5 can provide a stronger support than the single fin 112 of FIG. 3 for the heavy ballast bulb 205 and (3) for a specific asymmetrical effect, the fore and aft dimensions of appendage support 130 and cone 120,120*a* can be shorter in FIG. 5 in the fore/aft direction with savings in their bulk weights.

FIG. 6 illustrates an appendage unit 400 as another modification of the rotatable appendage unit 100 of FIG. 3 which results by attaching two symmetrical fins 112,212 to the cone bottom plate 120*a* of the appendage unit 400 in FIG. 6 to generate asymmetrical effects of both on both fins 112 and 212 in an aligned spaced fore and aft relationship. FIG. 6 can also be considered to be a modification of the rotatable two parallel fin appendage unit 300 of FIG. 5, the appendage unit 400 of FIG. 6 also being rotatable +10° to −10° from its centerline position. The shape of its ballast bulb 105 in FIG. 6 is further detailed in FIG. 9. Also, the two spaced and aligned A fins 112,212 in FIG. 6 may potentially have more asymmetric effect than the single fin 112 in FIG. 3 or the parallel fins in FIG. 5.

Figure 8A:
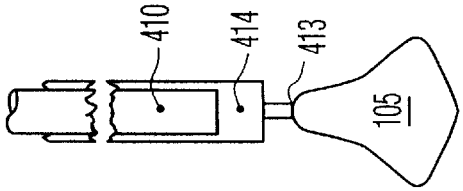
FIGS. 8, 8A, 8B, 8C, 8D, 8E and 8F illustrate a modification of the appendage unit in FIG. 7 by adding a trim tab to the aft portion of the aft element of the articulated fin.
Figure 8E:
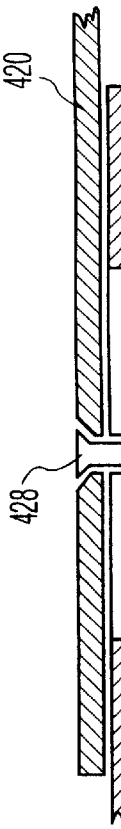
Figure 8F:
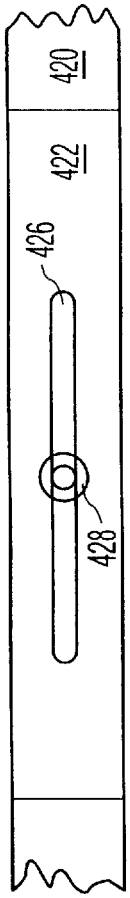
Figure 8:
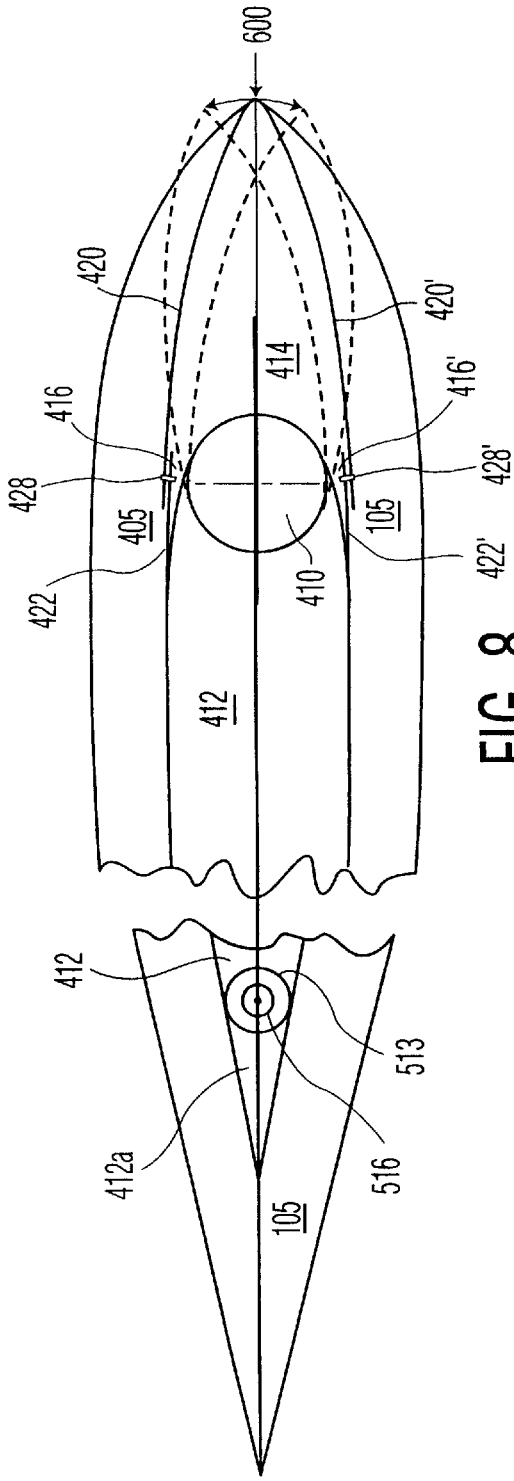
Figure 8B:
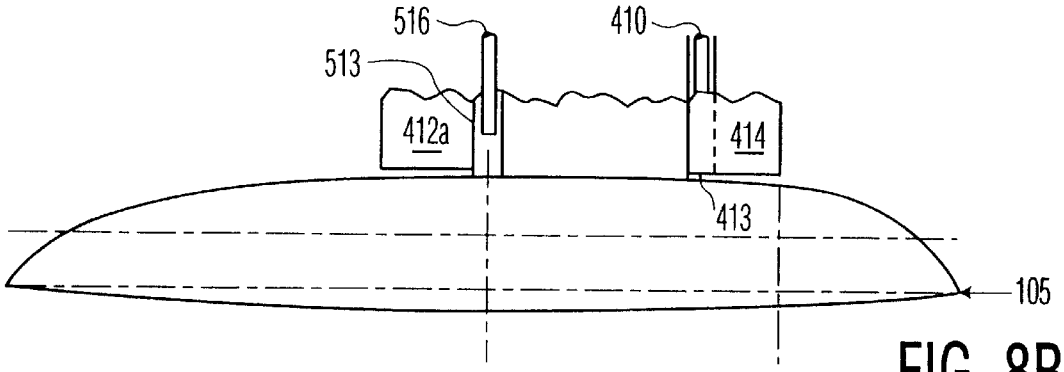
Figure 8D:
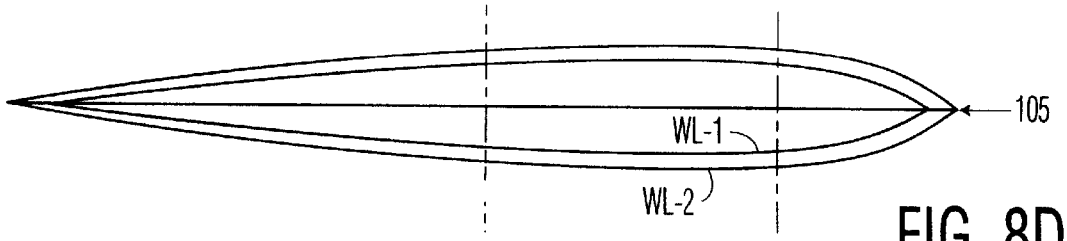
Figure 8C:
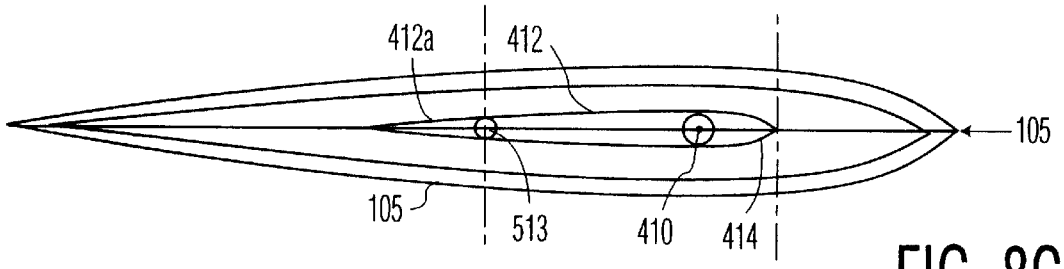

In another embodiment is shown in FIGS. 7 and 8 for producing a desired asymmetric effect with articulated fin components in appendage units 500 and 600. Each articulated fin has two differently shaped symmetrical segments, one of which is rotatable and one of which is fixed to the canoe body for forming a multitude of selective asymmetrically shaped keels to increase the VMG of the canoe body 10.

In FIG. 7, the symmetrical aft thin fin 412 (which in one design of the articulated appendage 500 had a thickness of four inches and a length of forty inches) is fixed to the bottom of the canoe body 10 and supports the heavy symmetrical ballast bulb 105 having a shape as detailed in FIG. 9 to provide ballast lift for making leeway when the canoe body is tacking. Fore fin 414 is rotatable relative to fin 412 by shaft 410. Since the fore fin 414 is considerably shorter than the aft fin 412 and does not carry the heavy ballast bulb 105, it can be rotated and satisfactorily supported by a prior art round shaft 410 in the manner that rudders are suspended from the canoe body, especially when the fore fin 414 is rotatably supported upon a pivot 413 fixed on the ballast bulb 105. Such construction permits the selective angular displacement of the fore fin 414 relative to the aft fin 412 so as to form either a symmetrical keel or an asymmetric keel for generating maximum hydrodynamic forces. When the short rotatable fore fin 414 of the articulated fin 414,412 of the appendage unit 500 is rotatably supported on a pivot 413 located on ballast bulb 105 (which is fixed relative to the canoe body 10), there is no need for a cone 120 and its appendage support 130 as illustrated in FIGS. 3, 4, 5 and 6. A ball and socket unit 413 between the rotatable fin 414 and the fixed fin 412 is strongly held together by the rotatable shaft 410 and the pivot 413 on the ballast bulb 105.

When the fore fin 414 is displaced from its angular alignment with aft fin 412, a detrimental port hollow 416 at the juncture of fins 414 and 412 is eliminated by port fairing members 420,422, the fairing member 420 being fixed to the rotatable fore fin 414 and a mating fairing member 422 being fixed to the fixed aft fin 412. The stiff fairing members 420,422 slidably overlap at their outboard ends with very little clearance therebetween to close off the port hollow 416 as fore fin 414 is rotated. Preferably, the fairing member 422 can have a longitudinal aperture 426 for slidably receiving a beveled flat headed rivet 428 which is flush recessed in the outer fairing member 420 and flattened at its outer end. As a result, the fairing members 420 and 422 are slidably hold together in a manner to more efficiently remove the port hollow 416 when fin 414 is angularly displaced from fin 412. Similar to fairing members 420,422 and associated components 426 and 428 on the port side, there is a pair of fairing members 420',422' and associated components 426' and 428' on the starboard side of the appendage 500 to close off a starboard hollow 416'.

For upwind sailing, the fore fin 414 is rotatable to form an asymmetrical keel to create favorable asymmetrical effects for generating favorable hydrodynamic forces. For downwind sailing, the fore fin 414 and the aft 412 fins are aligned to form a single symmetrical keel for minimizing downwind drag and for eliminating undesirable port or starboard keel hydrodynamic forces.

In the appendage unit 600 of FIG. 8, the asymmetric effect of the water track passing over the articulated appendage 500 of FIG. 7 can be increased by a skillful rotation of a trim tab 412*a* installed at the trailing edge of the fin 412. The rotatable joint between fin 412 and trim tab 412*a* has a ball and socket joint 513 so that the trim tab 412*a* can be angularly displaced by a vertical shaft 516. In the manner known in the prior art, shaft 516 is extended to the helmsman who skillfully rotates it in combination with a skillful rotation of fin 414 to produce a large asymmetric effect for the articulated appendage 600.

So as to reduce the hollow in the ball joint 513 when trim tab 412*a* is rotated, advantageously there can be installed port fairing members similar to 420 and 422 with components 426 and 428 and starboard fairing members similar to 420' and 422' with components 426' and 428' as shown in FIG. 7.

FIG. 9 illustrates the details of the shape of the ballast bulb 105 as shown in FIGS. 3, 4, 6, 7 and 8. Crossections of the ballast bulb 105 are shown at three spaced stations along its longitudinal axis in FIGS. 9B, 9C and 9D. The rounded port corners of ballast bulb 105 at 901, 901' and 901" and the starboard rounded corners at 902, 902' and 902" reduce ballast drag. The concave port sides 903, 903' and 903" and concave starboard sides 904, 904' and 904" permit advantageous lowering of the ballast center of gravity. The convex fore and aft horizontal sections WL-1, WL-2 of ballast 105 generate favorable keel lift when ballast member 105 is attached to the bottom of the fin keel as in FIGS. 3, 4 and 6 and rotates therewith so as to provide ballast lift when the rotatable fin keel is generating ballast lift as a consequence of the same angle of incidence of the fin and the ballast to the water track.

Symmetrical Wing Shapes

Useful shapes of wing sections have been developed, coded by NACA and published in "Theory of Wing Sections" by Abbott and Von Doenhoff, Dover Publications. While NACA has developed many shapes for very high speed air craft, some NACA shapes developed for aircraft are useful for applicants appendages with fins moving in water (which medium is incompressible) because at very high wing speeds in air, the air medium approaches incompressibility.

A few published NACA wing shapes which are useful for the applicants fin symmetrical shapes are:

1. NACA 63-006
2. NACA 0006
3. NACA 0008
4. NACA 0008-34
5. NACA 0010-34
6. NACA 0010-35
7. NACA 0010-65
8. NACA 16-006
9. NACA 16-009
10. NACA 63-006
11. NACA 63-009

By naval architectural calculations, tow tank testing and sea trials, improvements in the embodiments of this specification can be determined by experimentation for maximum performance of the sailing vessel. Also to be determined are the best locations for the center of wind pressure, center of water pressure, center of buoyancy, the yacht's mast, keel with the ballast member attached thereto, rudder, etc. Tow tank testing will also be useful for determining the best shape and contour of symmetrical fins to maximize the yacht performance.

While there has been described and illustrated the fundamental novel features of the present invention as applied to preferred embodiments, it will be understood that various omissions and substitutions and changes in the form and details of the illustrated keels for a Sailing Vessel and it's construction may be made using equivalents by those skilled in the art, without departing from the spirit and concepts of the invention.

What is claimed is:

1. A sailing vessel having a canoe body, a waterline therearound and an appendage depending therefrom, said appendage comprising a hollow member, a portion of the interior of said hollow member having a cylindrical surface, means for fixing said hollow member to said canoe body, a rotatable member juxtapositioned to and adapted to mate with said cylindrical interior surface of said hollow member, a shaft fixed to the upper portion of said rotatable member, means rotating and stopping said shaft to a selective angular displacement in said hollow member, a plate member fixed to the bottom of said rotatable member and means attaching at least one fin to said plate member perpendicular to the plane of said waterline, the axis of said rotatable member being perpendicular to said plate member.

2. A sailing vessel according to claim 1 wherein said shaft is threaded and said appendage is adapted to be a keel for said sailing vessel including a ballast member attached to said fin and a threaded nut deposed upon said threaded shaft which when tightened will bear upon said hollow member, said fin being rotatable in said hollow member until said nut is hard tightened upon said threaded shaft.

3. A sailing vessel according to claim 2 wherein the diameter of said threaded shaft is greater than the thickness of said fin.

4. A sailing vessel according to claim 1 including another fin attached to said plate member and said ballast member.

5. A sailing vessel according to claim 4 wherein said pair of fins are spaced from and parallel to each other.

6. A sailing vessel according to claim 4 wherein said two fins are linearly spaced with their chords fixed in lineal alignmnent as the rotatable member is turned.

7. A sailing vessel according to claim 2 including means in the interior of said canoe body to support said fin and said ballast attached at the end thereto in a manner to provide a moment arm greater than the thickness of said fin to resist the bending moment at the location where the fin joins the canoe body when said sailing vessel is heeled.

8. A sailing vessel according to claim 1 wherein said hollow member has at least one conical interior surface which slopes upwardly and towards the axis of rotation of said rotatable member, said rotatable member having at least one conical surface which is juxtapositioned to and adapted to mate with said conical interior surface of said hollow member.

9. A sailing vessel according to claim 1 wherein said ballast member in its upper portion has a series of concave crossections perpendicular to the plane of said waterline whereby said ballast member has a lower center of gravity.

10. A sailing vessel according to claim 1 wherein said ballast member has a series of convex crossections parallel to the plane of said waterline, whereby the ballast member together with the rotatable fin(s) can both generate hydrodynamic forces when they both have the same angle of incidence to the water track.

11. A sailing vessel according to claim 1 wherein said ballast member in its upper portion has a series of concave crossections perpendicular to the plane of said waterline, the canoe body is tacking with its bow pointed directly into the water track and the rotatable member is selectively turned so that the fin and ballast member are simultaneously making leeway with the same angle of incidence to the water track, the fin and the ballast member being selectively shaped so that each creates favorable separate asymmetric effects to decrease the leeward drift of the canoe body in accordance with the Energy Balance of the following formula:

$$We=(Fe+Fe')+(Le-Le')+He+Ke+(Te+Te') \quad (2)$$

where

We=Energy of the wind transferred to the canoe body when the canoe body is pointing directly into the water track Fe=Energy of the wind which forwardly propels the sailing vessel when the canoe body is pointing directly into the water track Fe'=Incremental energy available to increase the forward velocity of the canoe body when the keel (fin and the ballast member) are making leeway (both the fin and the ballast member are creating separate asymmetric effects)

Le=Energy wasted by the canoe body drifting leewardly by the wind when the keel (fin and the ballast member) is not making leeway Le'=Energy saved when the keel (fin and the ballast member) is making leeway He=Energy wasted by drag of the canoe body when it is pointing directly into the water track and the canoe body has no crabwise motion Ke=Keel (fin plus ballast member) drag wasted energy when it is making leeway Te=Total Entropy lost energy by the energy transfers when the keel (fin plus ballast member) is not making leeway Te'=Incremental increase in entrophy when the keel (fin plus ballast member) is making leeway whereby the forward velocity of the canoe body is increased by the asymmetric effect of the fin making leeway, the additional asymmetric effect of the ballast member making leeway and when "Le'" is greater than "Te'".

12. A method of increasing the forward velocity of a tacking sailing vessel according to claim 11 including a second fin, one end of which is fixed to said rotatable member and the other end of which is fixed to said ballast member.

13. A method of increasing the forward velocity of a tacking sailing vessel according to claim 12 wherein said two fins are spaced from and remain parallel to each other when the rotatable member is turned.

14. A method of increasing the forward velocity of a tacking sailing vessel according to claim 12 wherein said two fins are linearly spaced with their chords fixed in lineal alignment as the rotatable member is turned.

15. A sailing vessel according to claim 1 including a trim tab fin in juxtaposition to said fin and means rotating said trim tab fin about an axis parallel to the trailing edge of said fin.

16. A sailing vessel according to claim 1 wherein the canoe body is pointed directly into the water track.

17. A sailing vess competing a canoe body, a waterline therearound; a mast fixed to the canoe body, a sail carried by said fixed mast, an articulated fin having an aft member with its lineal leading edge in perpendicular relationship to the plane of said waterline; said aft member being fixed to the underside of said canoe body; a heavy ballast member fixed to bitter edge of said aft member, a fore member with a lineal trailing edge in rotatable contact with said lineal leading edge of said aft portion; a pivot means on the ballast member to support said rotatable fore member, means rotating said fore member, and means preventing water flow through the space between the leading edge of the aft member and the trailing edge of the rotatable fore member.

18. A sailing vessel according to claim 17 including a trim tab fin, means for rotatably supporting said trim tab fin on the pivot means so that its leading edge is in rotatable contact with the trailing edge of the said aft member of the articulated fin and means for selectively rotating said trim tab fin.

* * * * *

UNITED STATES PATENT AND TRADEMARK OFFICE
Certificate

Patent No. 6,349,659 B1 Patented: February 26, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Frederick E. Hood, Portsmouth, RI; Bernard Olcott, Weehawken, NJ.

Signed and Sealed this Eleventh Day of March 2003.

S. JOSEPH MORANO
*Supervisory Patent Examiner*
Art Unit 3617

UNITED STATES PATENT AND TRADEMARK OFFICE

CERTIFICATE OF CORRECTION

PATENT NO. : 6,349,659 B1 
DATED : February 26, 2002
INVENTOR(S) : Frederick E. Hood et al.

It is certified that error appears in the above-identified patent and that said Letters Patent is hereby corrected as shown below:

Title page,
Should read as follows:

Item -- [74] Attorney: Bernard Olcott --

Signed and Sealed this

Eighteenth Day of March, 2003

JAMES E. ROGAN
*Director of the United States Patent and Trademark Office*